United States Patent [19]

Doll

[11] Patent Number: 4,865,479

[45] Date of Patent: Sep. 12, 1989

[54] WRITING UTENSIL WITH AN EXCHANGEABLE ERASER

[75] Inventor: Helmut Doll, Spechbach, Fed. Rep. of Germany

[73] Assignee: Herlitz AG, Berlin, Fed. Rep. of Germany

[21] Appl. No.: 126,424

[22] Filed: Nov. 30, 1987

[30] Foreign Application Priority Data

Dec. 8, 1986 [DE] Fed. Rep. of Germany ..... 3642283

[51] Int. Cl.[4] ..... B43K 29/00; B43K 29/02

[52] U.S. Cl. ..... 401/17; 401/18; 401/23; 401/34; 401/202

[58] Field of Search ..... 401/17, 18, 20, 21, 401/23, 34, 202

[56] References Cited

U.S. PATENT DOCUMENTS

| | | | |
|---|---|---|---|
| 425,527 | 4/1890 | Spear | 401/20 |
| 3,941,488 | 3/1976 | Maxwell | 401/17 |

FOREIGN PATENT DOCUMENTS

| | | | |
|---|---|---|---|
| 2634273 | 2/1978 | Fed. Rep. of Germany | 401/18 |
| 486563 | 4/1918 | France | 401/34 |
| 613673 | 12/1948 | United Kingdom | 401/34 |

*Primary Examiner*—Steven A. Bratlie

*Attorney, Agent, or Firm*—Ralf H. Siegemund

[57] ABSTRACT

A writing utensil such as a fountain pen is provided with an erasing assembly having a sealing cap which closely covers the wick and is fitted onto the erasing tip in a form molding and friction holding manner; the open end of the cap is provided with an external thread, a similar external thread is formed at the erasing cartridge end of the erasing tip, the pen barrel and the end cap have corresponding internal threads and are threaded onto either the sealing cap or erasing cartridge.

2 Claims, 1 Drawing Sheet

WRITING UTENSIL WITH AN EXCHANGEABLE ERASER

BACKGROUND OF THE INVENTION

The present invention relates to a writing utensil such as a fountain pen, or in particular a cartridge pen, a pencil, a ball point pen, a felt tip pen etc. but in each instance being provided with a replaceable erasing portion or assembly which is located at the end of the pen remote from the nib or writing tip; the erasing portion or assembly includes an erasing cartridge with an erasing tip and is covered by means of an end cap fitted to the barrel of the utensil and both the barrel of the utensil and the end cap are designed to accommodate and seal the erasing tip.

A utensil realized as a fountain pen of this kind is known from German petty patent (utility model) 83 17 634. This writing implement makes possible the use of the erasing tip either together with the pen or as a separate item. The particular kind of pen has proven to be of practical value but it can be seen as disadvantageous that a seal must be present both in the barrel of the pen and in the end cap to provide the sealing for the erasing tip. Sealing however is an absolutely essential feature or function to be effective whereever and whenever the erasing part is not in use because of the erasing fluid that may evaporate quite easily through the wick.

The seals, which are provided in the form of a sealing cap in the barrel of the pen and in the end cap, or provided with a relatively large cavity due to the space required for the erasing cartridge and, therefore, the disadvantage arises that erasing fluid can evaporate into this cavity. Moreover, it can also be seen as disadvantageous that spare erasing parts for the fountain pen have to be fitted with their own protective cap until they are used and then the user has to remove and throw away the protective cap before the erasing parts are changed.

DESCRIPTION OF THE INVENTION

The underlying object of the invention is to design a working utensil such as a fountain pen of the kind referred to in the introduction so that the expense involved in providing the required sealing for the erasing tip is significantly reduced and at the same time the evaporation cavity around the covered wick of the erasing tip is reduced.

Therefore it is a specific object of the invention to provide a new and improved writing utensil such as a fountain pen, pencil, ball point pen, felt tip pen etc. with a replaceable erasing assembly which is located at the end of the utensil remote from the writing tip and includes an erasing cartridge with an erasing tip and is covered by an end cap fitted to the barrel of the utensil and both the barrel and the end cap are designed to accommodate and seal the erasing tip.

In order to significantly reduce the expense on the required sealing of the erasing tip and at the same time to reduce the size of the evaporation cavity around the covered wick of the erasing tip, the utensil, specifically the fountain pen has the following features in accordance with the invention.

The erasing assembly is provided with a sealing cap which closely covers the wick of the erasing tip and is fitted onto the erasing tip in a form molding manner and in a friction holding manner; preferably by means of separation the open end of the cap is provided with an external thread which is similar to an external thread formed at the erasing cartridge end of the erasing tip; the utensil barrel and the end cap exhibit internal threads corresponding to the external threads of the sealing cap and the erasing tip.

The advantages achieved with the invention are that the writing utensil such as a fountain pen, pencil etc. does not have to be provided with any integral seals because the erasing assembly itself has a sealing cap which alone takes over the function of the sealing caps which used to be provided in the barrel of the pen and in the end cap. Thus, spare erasing parts are designed identical to the erasing part provided as original equipment for the fountain pen and the sealing cap now constantly associated with the erasing tip surrounds the wick closely, providing a cavity into which only insignificant, practically negligible quantities of erasing fluid can evaporate.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Corresponding parts in the illustration have the same reference numbers. The two different erasing parts illustrated in the two figures each have differing designs in the upper and lower halves simply showing possibilities for the design of the erasing cartridge and the erasing tip.

Figure 1:
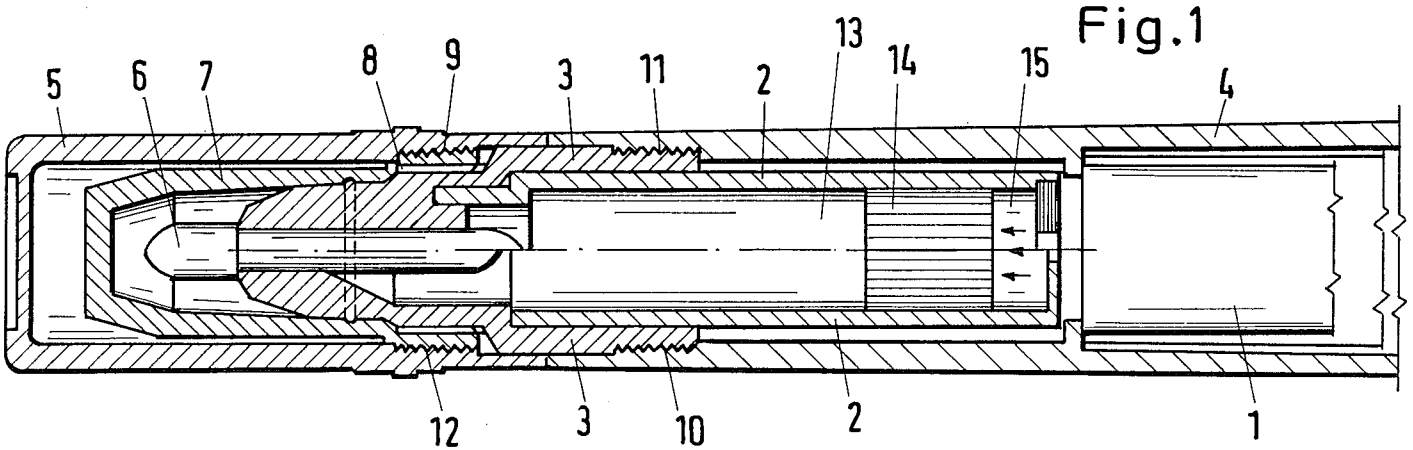
FIG. 1 is a longitudinal section through the rear part of the barrel of a cartridge pen with an erasing assembly and an end cap, the erasing cartridge of the assembly being disposed in the barrel of the pen.
Figure 2:
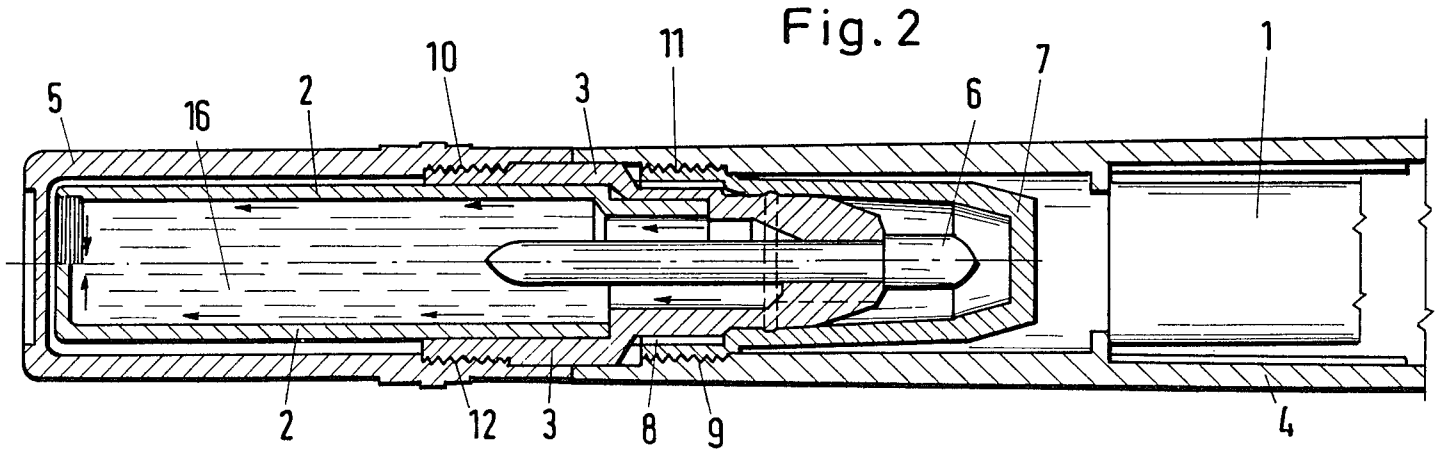
FIG. 2 is a view similar to FIG. 1 but the erasing cartridge being located in the end cap and the erasing part is of a so called tampon design with a long wick.

The cartridge pen illustrated in FIGS. 1 and 2 includes an ink cartridge 1 which is just indicated somewhat schematically cartridge 1, has a replaceable erasing assembly 2,3 which is located in the end of the pen and includes an erasing cartridge 2 with an erasing tip 3. The cartridge is covered by an end cap 5 fitted end-to-end to the pen barrel 4. The erasing assembly 2, 3 is provided with a sealing cap 7 which closely covers the wick 6 of the erasing tip 3, sealing cap 7 is fitted onto the erasing tip 3 in a form molding and friction holding manner. Such a connection is expediently achieved by means of a serrated profile connection 8.

Sealing cap 7 is provided at its end with an external thread 9 which is similar in pitch and other thread determining parameters to an external thread 10 provided in turn at the erasing cartridge end of the erasing tip 3. The pen barrel 4 and the end cap 5 are provided with internal threads 11 and 12 respectively which correspond to the external threads 9 and 10 of the sealing cap 7 and the erasing tip 3 respectively so that the erasing assembly 2, 3 as provided with the sealing cap 7 can either be screwed into the barrel of the pen (see FIG. 1) or into the end cap 5 (see FIG. 2) with the erasing cartridge 2 leading. In both cases the serrated profile connection 8 provides the required form molding connection between the sealing cap 7 and the erasing tip 3. The fact that this connection is also constituted as a friction holding connection ensures that the end cap 5 connected either to the sealing cap 7 or to the erasing tip 3 is seated securely at the end of the pen barrel 4. The thread (9) carrying portion of cap 7 envelops a portion of tip part 3 which portion is narrower in diameter than the end portion having thread 10.

The erasing cartridge 2 in FIG. 1 is filled with erasing fluid 13 and is sealed at the cartridge end by means of a silicon disk 14 leaving an air filled chamber 15 on its side remote from the fluid. The erasing cartridge 2 in FIG. 2 incorporates a tampon 16 impregnated with erasing fluid and is closed at the end.

It can be seen also that in FIG. 1 the external thread 9 of the sealing cap 7 is threaded into the inwardly directed thread 12 of the end cap 5 while the external thread 10 of erasing tip element and cartridge 3 is threaded into the internal thread 11 of the barrel 4.

In FIG. 2 on the other hand the stated order of the threaded connection is reversed, that is to say the external thread 10 of the tip element 3 is threaded into the internal thread 12 of the end cap 5 while the external thread 9 of the sealing cap 7 is threaded into the internal thread 11 of the barrel 4.

The erasing assembly 2, 3 in either case can be used in a variety of ways. In one arrangement, namely the one shown in FIG. 1 the erasing assembly 2, 3 remains inside the pen barrel 4 after removal of the end cap 5 with which the sealing cap 7 is also pulled off, i.e. the person using the fountain pen simply turns it round when he wishes to erase something he has written.

If an arrangement as shown in FIG. 2 is used, the erasing assembly 2,3 is withdrawn form the pen barrel 4 by means of the end cap 5 and the sealing cap 7 previously in the pen barrel.

The invention is not limited to the embodiments described above but all changes and modifications thereof, not constituting departures from the spirit and scope of the invention, are intended to be included.

I claim:

1. A writing utensil with a replaceable erasing assembly which is located at the end of the utensil remote from the writing tip and including an erasing cartridge with an erasing tip being covered by an end cap fitted to a barrel portion of the utensil both the barrel of the utensil and the end cap being designed to accommodate and seal the erasing tip, characterized by the combination of the following improvement features:

the erasing assembly having a simple sealing cap closely covering a wick extending from the erasing tip, said sealing cap being fitted onto the erasing tip in a form molding and friction holding manner;

an open end of the sealing cap being provided with an external thread, said tip having a narrower portion adjacent to which is situated the thread of the sealing cap, said tip having a wide portion being provided with a thread similar to said thread of the sealing cap and said pen barrel and said end cap each having internal threads respectively corresponding to the external threads of the sealing cap and of the erasing tip and being threaded thereto, in the stated or the inverse order.

2. The utensil as in claim 1, characterized in that a serrated profile connection is provided for the form molding and friction holding connection of the erasing tip and sealing cap.

* * * * *